United States Patent [19]

Viazmensky et al.

[11] Patent Number: 5,009,747

[45] Date of Patent: Apr. 23, 1991

[54] WATER ENTANGLEMENT PROCESS AND PRODUCT

[75] Inventors: Helen Viazmensky, South Windsor; Carl E. Richard, Enfield; James E. Williamson, Suffield, all of Conn.

[73] Assignee: The Dexter Corporation, Windsor Locks, Conn.

[21] Appl. No.: 374,482

[22] Filed: Jun. 30, 1989

[51] Int. Cl.[5] ..... D21H 27/02

[52] U.S. Cl. ..... 162/115; 162/135; 162/146; 162/208

[58] Field of Search ..... 162/115, 146, 208, 209, 162/168.1, 135; 28/104

[56] References Cited

U.S. PATENT DOCUMENTS

| | | | |
|---|---|---|---|
| 1,989,435 | 1/1935 | Wallquist | 156/208 |
| 3,485,706 | 12/1969 | Evans | 162/115 |
| 3,493,462 | 2/1970 | Bunting et al. | 162/115 |
| 3,620,903 | 11/1971 | Bunting et al. | 162/115 |

FOREIGN PATENT DOCUMENTS

| | | | |
|---|---|---|---|
| 149416 | 8/1920 | United Kingdom | 162/208 |
| 896002 | 5/1962 | United Kingdom | 162/115 |

*Primary Examiner*—Peter Chin

*Attorney, Agent, or Firm*—Chilton, Alix & Van Kirk

[57] ABSTRACT

A method for hydroentangling nonwoven fibrous sheet material to significantly increase the strength thereof at low latex add-on values employs small diameter jets of high-pressure water in the form of coherent streams that concentrate the hydraulic energy over a distance equal to approximately the diameter of the fibers being entangled. While fiber entangling water jets have been utilized heretofore, the present invention employs a relatively lower pressure for the fiber rearrangement along with a synergistic effect of wood pulp and long polyester fibers coupled with small amounts of latex to achieve the unexpectedly high strengths within these light weight materials. The resultant sheet material possesses excellent uniformity of fiber distribution and improved strength characteristics over those typically obtained from prior art water jet enganglement processes requiring 300–2000% the enganglement input energy employed in this process.

16 Claims, 3 Drawing Sheets

WATER ENTANGLEMENT PROCESS AND PRODUCT

The present invention relates generally to novel nonwoven textile materials and processes for their production. More particularly, it is concerned with a new and improved water jet entangled nonwoven material formed as an essentially homogeneous, wood pulp-containing substrate via a papermaking process.

BACKGROUND

Loose assemblies of staple fibers commonly referred to as "batts" must be bonded or secured in some fashion to make them into useful, easily handled and saleable nonwoven products. This requirement has lead to the development of not only various felting processes referred to as mechanical entanglement, but also to a great many types of chemical binders using either solvents or synthetic polymer dispersions. Additionally several processes have been employed wherein the energy of high pressure water jets is used to entangle the fibrous substrate. The latter processes are referred to as hydroentanglement or water-jet entanglement.

Mechanical entanglement processes bind or secure the fibers in the substrate by impaling the batts with a large number of barbed needles in a device called a needle loom. This action pushes fibers from the material's surface into the bulk of the batt. While strength properties are improved by this entangling of fibers within the batt, the process is slow, the needles damage the fibers and are themselves worn out rapidly, and the process is inherently suited only to the entanglement of heavy weight substrates.

The use of chemical binders also improves coherency and strength but has its own list of disadvantages. The substrate must be dried, dipped in the latex bonding solution, dried again, and heated to crosslink the polymer, thus markedly increasing the energy required to produce a final article. The polymeric latices also stiffen the final product, leading to the use of expensive post-treatments to soften the bonded web.

In order to avoid these problems nonwoven processes have been developed which use the energy of small-diameter, highly coherent jets of high pressure water to mimic the entangling action of the older needle loom. Initially, the water jet treating process involved the use of preformed dry-laid, fibrous web materials that were supported on an apertured surface so that the streams of water directed at the web material would move or separate the fibers and cause a pattern of varying densities and even apertures therein. In most instances, the resultant web simply evidenced a rearrangement of the fibers in the preformed sheet material, with the rearranged fibers exhibiting very little, if any, actual fiber entanglement. The rearrangement resulted from the use of water at a pressure sufficient to move the fibers sideways, but insufficient to entangle them effectively. Typical examples of this type of sheet material may be found in Kalwaites U.S. Pat. No. 2,862,251. These fiber-rearranged and apertured web materials frequently required significant amounts of binder to impart strength sufficient to permit further handling of the sheet materials.

It has also been found that high pressure water jets can be used as an entangling force operating on preformed nonwoven web materials prepared by carding or air laying. The jets of water entangle the fibers so that the material is held together by interfiber frictional forces in a way similar to that in which staple fibers are spun into a composite yarn for the production of conventional textiles. The patent to Guerin, U.S. Pat. No. 3,214,819, describes a method in which water jets are used to provide an entangling action similar to that provided with the barbed needles of a mechanical needle loom. However, this technique is perhaps best exemplified by the Evans U.S. Pat. No. 3,485,706. The technology further developed so as to provide entangled but non-apertured nonwoven material by using high pressure liquid jets and a relatively smooth supporting member as described by Bunting, et al in U.S. Pat. Nos. 3,493,462, 3,508,308, and 3,620,903.

The resultant entangled materials exhibited advantageously improved physical strength and softness relative to either mechanically entangled materials, or those fabrics which were bonded by chemical binders. The binder-free fabrics are not stiffened by the polymeric material, the water jets do not damage the fibers as they entangle them, and the product can be patterned as part of its production process. For these and other reasons the hydroentanglement process has supplanted earlier processes for demanding end uses. However, there are inherent disadvantages in even this process. The energy required to produce strong binder free product is very large, and the equipment needed to provide very high pressure water jets is very expensive. A highly uniform starting web or batt is needed or the high pressure water will produce holes and other irregularities in the product. The width of product was limited by the width of machinery available to produce uniform starting material. More economical fluid entanglement processes which operate at somewhat lower water pressures have also been disclosed by Suzuki, et al in U.S. Pat. Nos. 4,665,597, 4,805,275 and by Brooks et al in U.S. Pat. No. 4,623,575.

In substantially all of these prior art techniques, a precursor or preformed web material was formed, generally by air laying or carding, and subsequently was subjected to entanglement by the water jet method. Although most precursor webs were formed by an air laying system or by carding, some preformed wet-laid web materials or papers have also been mentioned. The air-laid webs, however, have been preferred since they are believed best for providing the desired isotropic properties, that is, equal physical properties in both the machine and cross-machine directions. Where carding techniques were employed, a preformed web was typically made using a cross-laying technique to provide the appropriate fiber orientation.

When it is desired to incorporate wood pulp fibers into the final sheet material, techniques such as those disclosed in Kirayoglu's U.S. Pat. No. 4,442,161 and Shambelan's Canadian Patent 841,938 have been employed. As described in the U.S. patent, a very light preformed tissue paper is layered on top of a preformed textile fiber web and high pressure water jets are directed against the tissue paper to join the two in a process reminiscent of needle punching, by destroying the tissue's structure and forcing the wood pulp fibers into the textile fiber web to provide the desired integrated composite structure having improved liquid barrier properties. However, no claims are made for any enhancements in web strength as a result of the inclusion of the wood pulp fibers into the composite structure. The Canadian patent teaches entanglement of papermaking fibers containing up to 25% textile staple fibers, the entanglement taking place prior to the drying of the wet-laid sheet and without the use of adhesives. The patent emphasizes hydroentangling lamination of multiple layers.

SUMMARY OF THE INVENTION

It has now been found according to the present invention that the water jet entangling technique can be adapted to wet-laid fibrous materials, to provide not only a new and improved process at reduced cost, but also very lightly entangled wet-laid fibrous webs having a more isotropic distribution of different types of fibers and improved entanglement-induced strength characteristics derived from the synergism between the very lightly entangled wet-laid web and a low add-on of chemical binder. This can be achieved by ultra-low energy water-jet entanglement, hereinafter abbreviated as "ULE", at the wet end of a papermaking machine while the fibrous web is highly fluid and prior to the drying operation. Using this method, it is possible to incorporate ULE into a wet-laid nonwoven web and thereby achieve an essentially homogeneous integration of conventional papermaking fibers and long synthetic fibers at economic production rates and relatively low entanglement input energies.

The invention further provides a novel and economical process for producing strong yet soft nonwovens having small amounts of binder and containing wood pulp that is uniformly distributed throughout the product. Advantageously these nonwovens products exhibit improved strength and softness characteristics utilizing ULE in-line while the fibrous material is still wet.

Other features of the present invention will be in part obvious, and in part pointed out in more detail hereinafter.

These and related advantages are achieved by forming a dilute homogeneous fiber furnish containing a regulated mixture of papermaking fibers and long synthetic fibers, and depositing the fibers from this furnish on a paper forming wire at the wet end of a paper-making machine to provide a fluidized and essentially homogeneous fibrous base web material having a fluid content of about 75% by weight or more and subjecting the base web in its fluidized condition to a series of entangling water jets to very lightly entangle the fibers in the base web without driving from the web a substantial amount of the short papermaking fibers, drying the entangled web and treating the dried web with a low level of binder. The resultant sheet material possesses excellent uniformity of fiber distribution and improved strength characteristics over those typically obtained from prior art water jet entanglement processes requiring 300–2000% the entanglement input energy employed in this process.

A better understanding of the features and advantages of the invention can be obtained from the following detailed description and the accompanying drawings. The description sets forth illustrative embodiments of the invention, and is indicative of the way in which the principles of the invention are employed. The accompanying drawing aids in understanding the process, including the sequence of steps employed and the relation of one or more of such steps with respect to each of the others, and the resultant product that possesses the desired features, characteristics, compositions, properties and relation of elements.

DESCRIPTION OF A PREFERRED EMBODIMENT

Figure 1:
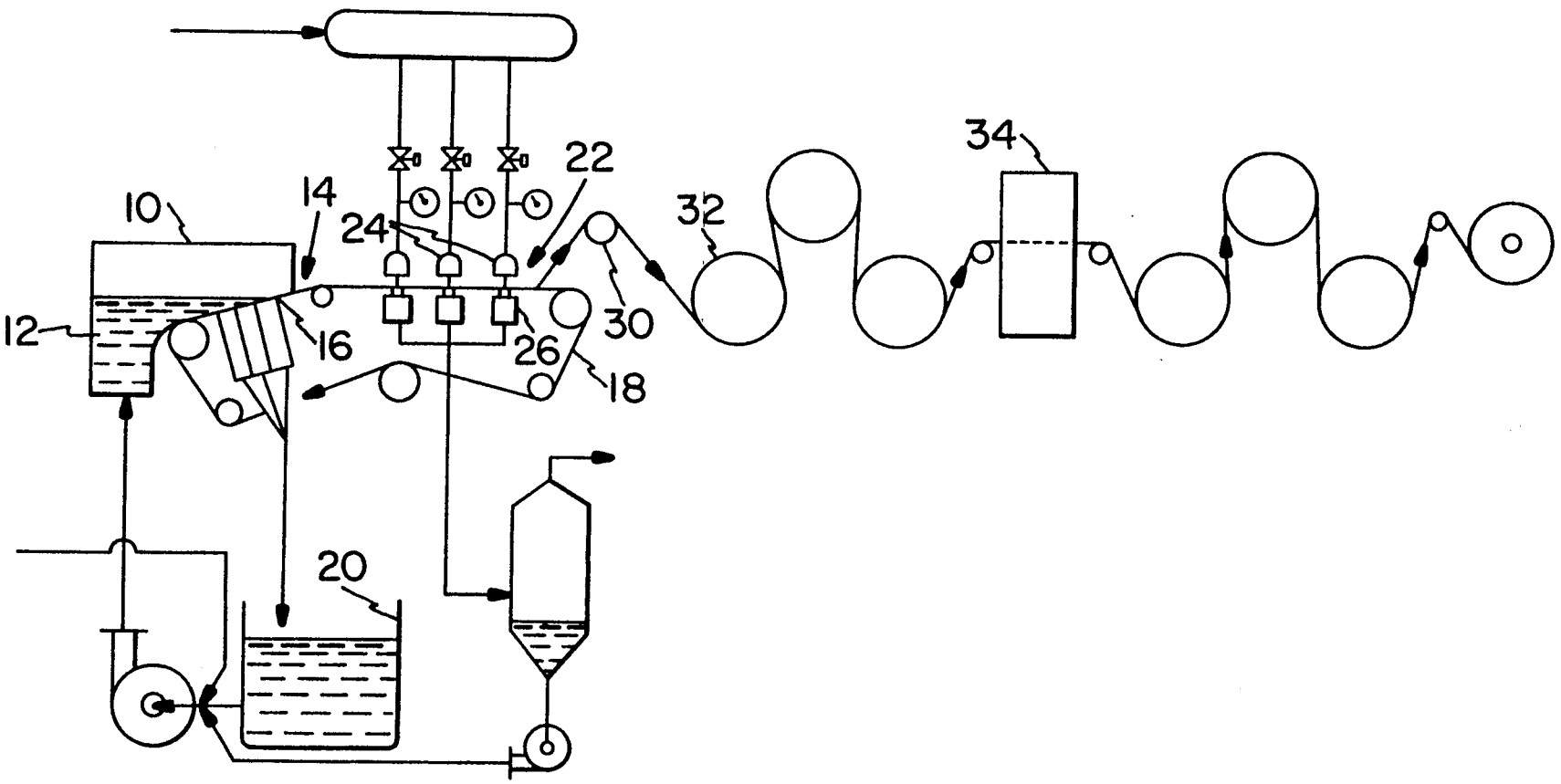
FIG. 1 is a schematic side elevational view of one form of a papermaking machine incorporating the features of the present invention.

In carrying out the present invention, a fibrous base paper is initially produced in the form of a continuous web material in accordance with known and conventional long fiber papermaking techniques. The nonwoven fibrous base web used to produce the materials of the present invention which possess the improved properties, characteristics, and uses set forth herein, is made by a wet papermaking process that involves the general steps of forming a fluid dispersion of the requisite fibers and depositing the homogeneously dispersed fibers on a fiber-collecting wire in the form of a continuous fluidized sheet-like fibrous web material. The fiber dispersion may be formed in a conventional manner using water as the dispersant or by employing other suitable fluid-dispersing media. Preferably, aqueous dispersions are employed in accordance with known papermaking techniques and, accordingly, the fiber dispersion is formed as a dilute aqueous suspension or furnish of papermaking fibers. Since the ratio of synthetic fiber to wood pulp or other short fibers in the fibrous mixture has been found to be important to the properties of the finished web, the mixture is controlled by either a semi-continuous batch mixing mode, or by separate preparation and storage of each constituent with subsequent metering of each to the headbox so that the proportions of each fiber in the final furnish are carefully controlled. The fiber furnish is conveyed to the web forming screen or wire, such as a Fourdrinier wire of a paper machine, and the fibers are deposited on the wire to form a fibrous base web or sheet that can be subsequently dried in a conventional manner. The base sheet or web thus formed may be treated either before, during, or after the complete drying operation with the desired latex solution, but in the preferred embodiment is treated subsequent to drying.

Although substantially all commercial papermaking machines including rotary cylinder machines may be used, it is desirable where very dilute fiber furnishes and long synthetic fibers are employed to use an inclined fiber-collecting wire such as that described in U.S. Pat. No. 2,045,095, issued to Fay H. Osborne on June 23, 1936. The fiber furnish flowing from the head box is retained on the wire as a random 3-dimensional fibrous network or configuration with slight orientation in the machine direction while the aqueous dispersant passes quickly through the wire and is rapidly and effectively removed. Typically, the fiber furnish used in the papermaking operation is adjusted as required to achieve particular properties in the resultant end product.

Since the use of the material produced in accordance with the present invention may have wide and varied applications, it will be appreciated that numerous different fiber furnishes may be utilized in accordance with the present invention. Typically, a portion of the fiber furnish is made up of conventional papermaking wood pulp fibers produced by the well known Kraft process. These natural fibers are of conventional papermaking length and have the advantage of retaining the component that contributes significantly to the strength of the fibrous nonwoven structure. In accordance with the present invention, the amount of wood pulp used in the furnish can vary substantially depending on the other components of the system. However, the amount used should be sufficient to contribute to the integrity and strength of the web particularly after the entanglement treatment and addition of binder employed in accordance with the present invention.

Additionally, to provide improved strength, it is preferred that the particular fiber furnish be a mixture or blend of fibers of various types and lengths. Included in this blend are long synthetic fibers that contribute to the ability of the fibrous web to undergo the entanglement process and help in the transport of the fluidized web at the wet end of the papermaking machine. The synthetic fiber component of the wet-laid web can consist of rayon, polyester, polyethylene, polypropylene, nylon, or any of the related fiber-forming synthetic materials. Furthermore, the synthetic fiber geometry should consist of a length to diameter, or aspect, ratio of from 500–3000. Fiber denier and length can range from 0.5 to 15 denier, and from 0.5 to 1.5 inches, respectively. The preferred denier and length are 1.0–2.0 denier, and 0.5–1.0 inch, yielding a preferred L/D ratio of 1000–1500. As will be appreciated, longer fibers may be used where desired so long as they can be readily dispersed within the aqueous slurry of the other fibers at low consistencies. However, significantly increasing the length of the fibers beyond the lengths indicated herein appear to offer little additional benefit. Of course, where the lengths are less than about 12–15 millimeters, difficulty is encountered in the entanglement thereof and lower strength characteristics are obtained.

In addition to the conventional papermaking fibers such as bleached kraft, the furnish of the present invention may include other natural fibers that provide appropriate and desirable characteristics depending upon the desired end use of the fibrous web material. Thus, in accordance with the present invention, long vegetable fibers may be used, particularly those extremely long natural unbeaten fibers such as sisal, hemp, flax, jute and Indian hemp. These very long natural fibers supplement the strength characteristics provided by the bleached kraft and at the same time provide a limited degree of bulk and absorbency coupled with a natural toughness and burst strength. Accordingly, the long vegetable fibers may be deleted entirely or used in varying amounts in order to achieve the proper balance of desired properties in the end product.

Figure 2:
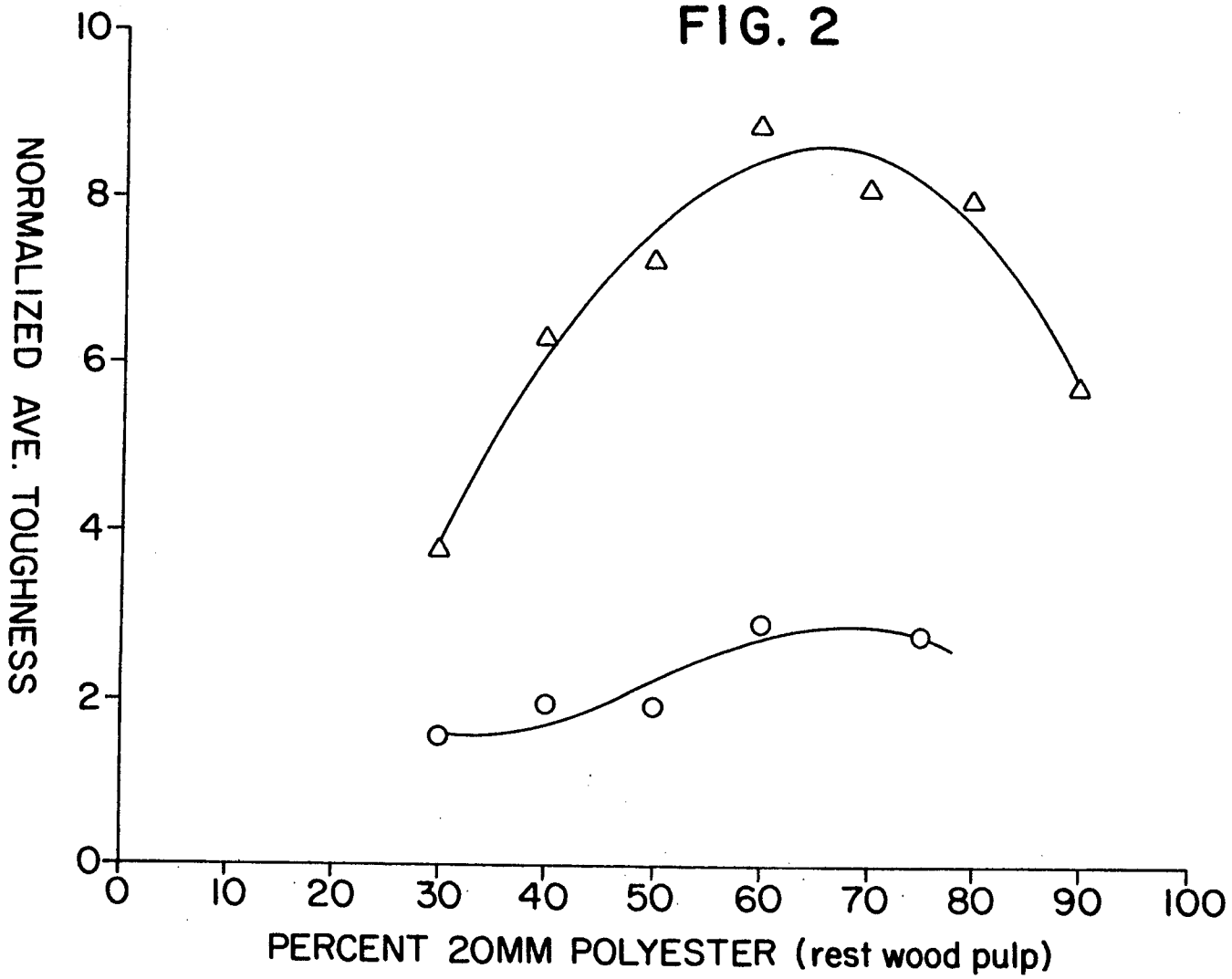
FIG. 2 is a graph showing strength characteristics as a function of fiber compositions for the web of the present invention.

Although the amount of synthetic fiber used in the furnish may vary depending upon the other components, it is generally preferred that the percent by weight of the synthetic fiber be greater than 30% and preferably fall within the range of 40%–90%. Optimum strength characteristics including improved tensile, tear, and toughness are achieved together with a softer and more supple hand when the wood content of the fiber furnish falls between 20% and 60% and preferably is about 30–40%. As indicated in FIG. 2, maximum strength characteristics are achieved when the synthetic fiber content falls with the range of about 50–80% of the furnish by weight.

Using a conventional papermaking technique, the fibers are dispersed at a fiber concentration within the range of 0.5 to 1.5%, by weight, held in agitated tanks to provide continuous flow to the headbox, and are diluted preferably to a fiber concentration of from 0.005% to 0.15% by weight. As will be appreciated, papermaking aids such as dispersants, formation aids, fillers, and wet strength additives can be incorporated into the fiber slurry prior to web formation to assist in web formation, handling and final properties. These materials may constitute up to about 1% of the total solids within the fiber furnish and facilitate uniform fiber deposition while providing the web with sufficient integrity so that it will be capable of undergoing the subsequent treating operations. These include natural materials such as guar gum, karaya gum and the like, as well as synthetic polymer additives.

As described above, the dilute aqueous fiber furnish is fed to the headbox of a papermaking machine, and then to the fiber-collecting wire where the fibers are homogeneously and uniformly deposited to form a continuous base web or sheet, having a water content in excess of about 75% by weight. The high water content provides a fluid medium in which the fibers have relatively high mobility while retaining sufficient integrity to act as a unitary hydrated waterleaf.

While this high water content base web is still on the fiber-collecting wire, and prior to any drying thereof other than conventional suction to remove excess fluid, the base web is subjected to a water-jet treatment to lightly entangle the fibers. This is accomplished by passing the fibrous base web under a series of fluid streams or jets that directly impinge upon the base web material with sufficient force to cause entanglement of the fibers therein. As can be appreciated, the fibers within the base web are still in a quasi-fluid condition due to the high water content and can be readily manipulated and entangled by the water jets operated at low to moderate energy levels. Preferably, a series or bank of jets is employed with the orifices and spacing between the orifices being substantially as indicated in the aforementioned Suzuki U.S. Pat. No. 4,665,597. The jets are operated at a pressure of about 20 to 70 kilograms per square centimeter, but lower pressures are utilized where lighter weight materials are being entangled, or the web to be entangled is moving very slowly through the treatment zone. Vacuum boxes are provided beneath the wire and below each nozzle array in order to rapidly remove the excess water from the entanglement zone of the web-forming wire. After the entanglement operation, the entangled web material is further vacuum treated, removed from the forming wire, dried, treated with a low level of polymeric binder, and redried as indicated hereinbefore. The basis weight for the resultant web material typically falls within the range of 15–100 grams per square meter.

It has been found that when the interactive matrix composite effects of the fibrous furnish and binder are combined with the effects of ULE, a synergism occurs that results in a 3–4 fold increase in TEA (Tensile Energy Absorption as defined and measured by TAPPI Method T 494 om-88) or toughness. The two curves in FIG. 2 graphically demonstrate this phenomenon. The upward displacement is solely attributable to the application of only 0.11 hp-hr/lb total energy input, as described by the following formula:

$$E=0.125\ YPG/bS$$

where:

Y = number of orifices per linear inch of manifold width

P = pressure in psig of liquid in the manifold

G = volumetric flow in cubic feet per minute per orifice

S = speed of the base web under the water jets, in feet per minute, and b = the basis weight of the fabric produced, in ounces per square yard.

The total amount of energy E expended in treating the web is the sum of the individual energy values for each pass under each manifold, if there is more than one. It is important to note that the strength levels obtained in the 50–70% range of polyester loading is greater than those obtained using prior art techniques, such as those disclosed in, e.g., U.S. Pat. Nos. 3,485,705, 4,442,161, and 4,623,575, all of which employ 3–10 times the expended energy of the current invention.

Referring now to FIG. 1 of the drawings, the wet end of a papermaking machine is schematically shown as including a headbox 10 for supplying a fiber furnish 12 uniformly to a wet-forming station 14 housing an inclined portion 16 of a fiber-collecting wire 18. The furnish engaging the wire at the web-forming station 14 deposits the fiber on the wire while the major portion of the aqueous dispersing medium passes through the wire and is withdrawn by a conventional white water collection box 20. The consolidated fibrous sheet or base web has a fiber consistency of about 8–12% by weight at this point. This highly hydrated but unitary fibrous waterleaf is carried by the wire 18 as it moves in a clockwise direction as shown in FIG. 1 to an entanglement zone or station 22 immediately adjacent the forming station 14.

As illustrated, the web-forming wire is horizontal as it passes through the entanglement zone 22 which, in the embodiment illustrated, incorporates a bank of three nozzle manifolds 24. Persons skilled in papermaking will recognize that the wire need not be horizontal, but that comparable effects will be achieved whether the water jets are above a horizontal wire, or a wire which slopes either down or up. Each nozzle manifold 24 within the nozzle bank is provided with an individual vacuum box 26 located beneath the web-forming wire 18 and in direct alignment with its respective manifold. Each manifold includes a nozzle plate having two staggered rows of nozzles with each nozzle having an orifice size generally within the range of 0.05 to 0.2 mm in diameter and preferably about 0.1 mm. The apertures within each row are spaced apart a distance of about 0.2 to 2 mm and preferably are approximately 1.0 mm apart. Water is pumped through the orifices as fine columns or jets at a pressure of up to 1200 psi. The jets of water directly impinge on the fluidized fibrous web to provide light entanglement of the fibrous web material without adversely affecting the homogeneity thereof. As the fibrous material passes under the jets, a light entanglement is achieved that is somewhat comparable to that achieved in accordance with the initial stage described in the Suzuki U.S. Pat. No. 4,665,597, and is significantly less than that achieved in the Brooks U.S. Pat. No. 4,623,575. Under these conditions the total energy imparted to the web can range from about 0.01 to 0.20 hp-hr/lb depending on the web basis weight, the manifold pressure, and the machine speed. Excellent results have been obtained at a total energy input in the range of 0.05 to 0.12 hp-hr/lb. The high water content of the base web material tends to absorb some of the force of the water jet while at the same time allowing free motion of the fibers, particularly the long fibers, to provide the desired intertwining entanglement.

Unlike previously disclosed water jet entanglement processes, the wire used in the disclosed process must perform a dual role. It must function as the forming fabric for the web forming portion of the process, with associated concerns of good fiber retention and easy release for the web. It must also function as a support device for the entanglement process. The design and construction of the wire must thus provide good sheet support, first pass retention of the fibers, good wear life, and minimum fiber bleed-through, especially in the case of long fiber furnishes. At the same time, the wire must also provide support for the web during the entanglement phase prior to removal of the web for transport to the drying sections of the apparatus. For the entanglement part of the process, the wire must minimize fiber loss while preventing stapling of the long synthetic fiber component of the furnish into the interstices of the Fourdrinier fabric. It has been found that a Fourdrinier fabric of single layer construction is a prime requisite in preventing stapling. For non-patterned webs, fabrics of greater than 60 mesh are used and are preferably in the range of 80–100 mesh. Fourdrinier fabrics of 2 and 3 layer construction tend to entrap an unacceptable quantity of the synthetic fiber component of the furnish during entanglement, so that when the web is removed from the wire a fuzzy surface of raised synthetic fiber remains and represents not only a wire cleaning problem, but a yield loss which can be significant.

The vacuum boxes 26 below the forming wire 18 incorporate one or more vacuum slots. Additionally, one or more additional or final vacuum boxes may be spaced downstream from the entanglement zone 22 to remove further excess water from the base web material before that material reaches the couch roll 30 where it is removed from the web-forming wire for subsequent drying on drums 32 and treatment with an appropriate latex binder.

The entangled dried fibrous web material proceeds to a binder application station 34 of conventional design. For example, the lightly entangled web material may be passed through a print bonding station which employs a set of counter-rotating rolls, but preferably is treated in a size press to apply the binder uniformly to the sheet material. The binder pickup typically falls within a range of about 3–20% based on the total weight of the treated material. The preferred range of binder content is 3–15%.

The specific latex binder employed in the system will vary depending on the fibers employed and the characteristics desired in the end product. However, generally, acrylic latex binders are employed since they assist in providing the desired strength, toughness, and other desirable tensile properties. These binders also help to retain the soft and pleasing hand which is characteristic of the entanglement process. For these reasons, it is generally preferred that the binder system be a cross-linkable acrylic material such as that manufactured by B. F. Goodrich under the tradename "PV Hycar 334". This material is believed to be a latex with an ethyl acrylate base.

Figure 3:
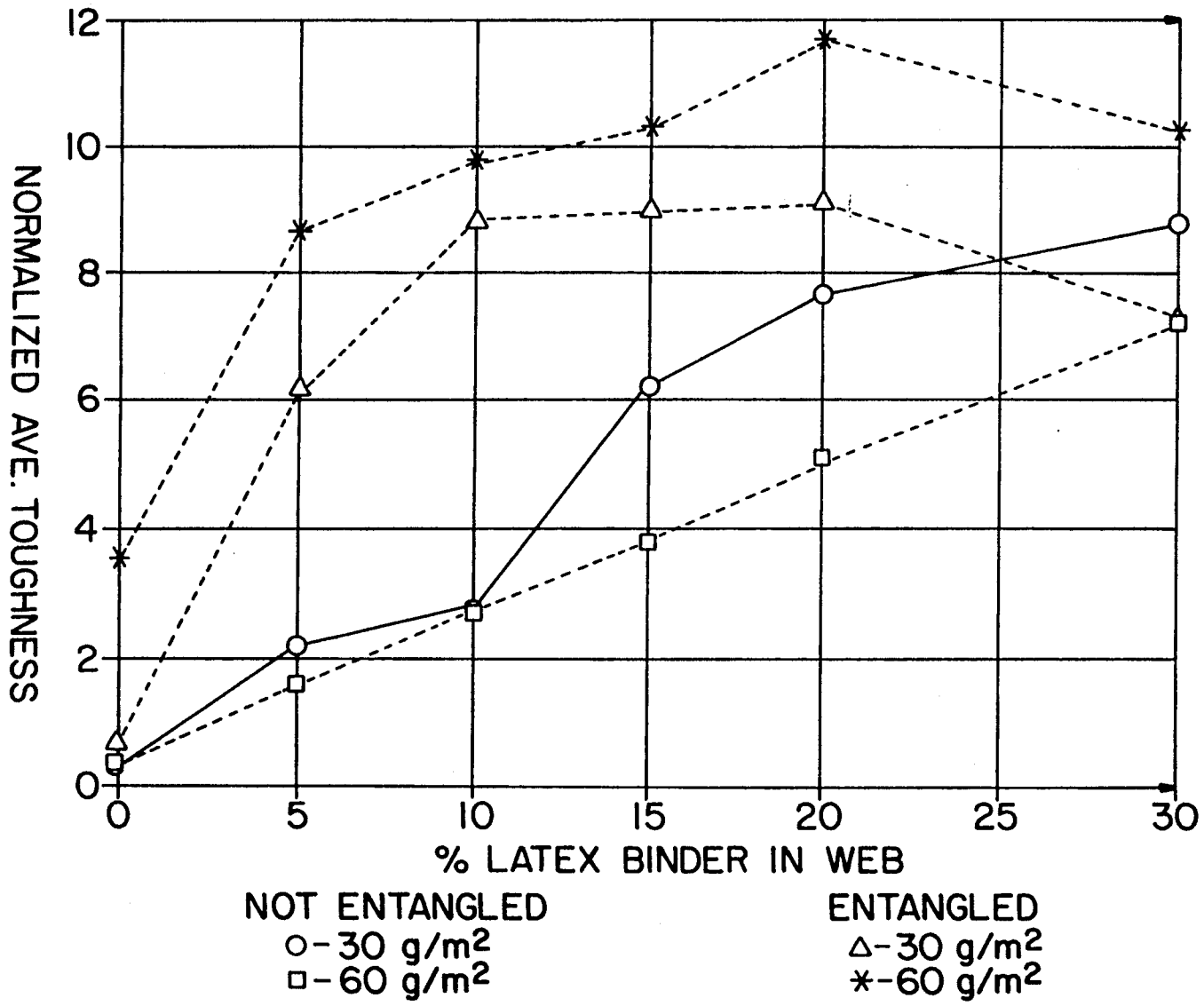
FIG. 3 is a graph showing the strength characteristics of a preferred fiber composition material at different levels of entanglement.

As mentioned above, the properties of the resultant web material after ULE and treatment with a small amount of latex binder shows significant strength characteristics. In fact, it has been discovered that there is a synergistic effect between the light entanglement of the essentially homogeneous, wood-pulp containing web, and the latex treatment that allows the product to achieve high strengths at even low latex add-ons, that is, at add-ons of 10% and less by weight. In this connection, it has been found that materials produced in accordance with the present invention exhibit a normalized average dry tensile energy absorption, TEA, or toughness that is four to six times greater than identical material that has not received the water jet entanglement treatment, but has been impregnated with an identical amount of binder. FIG. 3 shows a typical plot of strength versus the amount of binder for varying levels of entanglement. It is clear from this figure that significant benefits result when low levels of entanglement are coupled with the addition of latex binder to a wood pulp/long polyester substrate web.

The base web material utilized in accordance with the present invention preferably is a blend of synthetic and natural fibers that are homogeneously dispersed and deposited on the web-forming wire. Thus, unlike the prior dry formed webs that attempted to incorporate water dispersable fibers therein, the base web of the present invention is a substantially homogeneous and isotropic blend of natural and synthetic fibers, designed to achieve the beneficial characteristics of each. Typically, larger amounts of wood pulp added to the fiber furnish result in a lower cost but also a lower strength for the resultant products, while increased amounts of synthetic fibers produce variably higher strength at increased costs. Thus it is easier to provide fiber blends that can be tailored to yield an appropriate accommodation between desirable strength properties and low cost using the wet forming process in accordance with the present invention.

The preferred fiber composition coupled with a binder content that is greater than 3%, and the substantially homogenous character of the fibers within the web material, help to provide the desirable and unique features of the resultant end product. The process utilizing these amounts of materials can provide significant cost savings. Another result of the current invention is the energy savings involved in using lower water pressures for entanglement. In fact, it is well known in the industry that the input energy used in prior processes are in the vicinity of about 1.0 hp-hr/lb. In the Brooks et al U.S. Pat. No. 4,623,575, two examples of their "light" entanglement fall in the input energy range of 0.48–0.52 hp-hr/lb.

Thus the prior art employs significantly higher levels of entanglement energy and therefore represent a more costly process to operate than the 0.01–0.20 hp-hr/lb energy consumption of the present invention.

A significant advantage of the disclosed process relates to the isotropic web structure that is an inherent characteristic of the wet-lay process, but not a characteristic of the dry processes, such as carding or air-laying. Whereas the dry-laid processes generally produce webs with CD/MD tensile ratios in the range of 0.10–0.50, the wet-lay process can easily produce tensile ratios between 0.10–0.80 which are controllable and reproducible throughout that range. For product applications such as medical garments and disposable industrial garments, it is most desirable for the CD/MD ratio to be above 0.5 for optimum performance.

A further advantage of the present invention is the fact that products of this process are relatively lint-free when compared to products of prior art entanglement processes, or the products of other nonwoven processes. The volumes of water used to entangle the fibers in the web are sufficient, and at sufficiently high pressure, to remove all small, loosely attached fiber fragments and contaminants. The addition of small amounts of binder further improves the lint-free characteristics by securely locking any remaining fragments into the web. Thus the resultant web materials of this invention are suitable for use in environments in which low lint is desirable, such as hospital supply wraps, wipes, especially clean room wipes, wall cover backing, disposable apparel and the like.

In order that the present invention may be more readily understood, it will be further described with reference to the following specific examples which are given by way of illustration only, and are not intended to limit the practice of this invention.

EXAMPLE 1

A series of handsheets was made using a Williams-type sheet mold. The fiber furnish consisted of varying amounts of 20 mm × 1.5 denier polyethylene terephthalate staple fibers and cedar wood pulp sold by Consolidated Celgar under the trade name "Celfine". The handsheets varied in polyester content from 0–75%. The untreated basis weight was maintained at about 53 grams per square meter (1.56 ounce per square yard). The handsheets were padder treated with a crosslinkable acrylic latex binder sold under the trademark "HYCAR 2600×330" by B. F. Goodrich to a binder content of 13 percent. After drying, the handsheets were cured in an oven at 350 degrees Farenheit for 1 minute. Finished basis weight was 60 grams (1.77 ounces per square yard). These sheets were labelled 1-A through 1-F.

Another series of handsheets was made using the same furnish and target untreated basis weight. The difference with these sheets was that the polyester content ranged from 30–90%, and before each handsheet was dried it was passed under a hydraulic entanglement manifold twice at a nozzle-to-web distance of ¾ inch and a speed of 40 feet per minute. The manifold was operating at 500 psig and contained a nozzle strip having 92 micron diameter holes spaced 0.5 mm apart. Using the previously reference formula, the total energy applied to each sheet was 0.11 hp-hr/lb. The entangled webs were then padder treated, and cured identically to the non-entangled handsheets. The entangled sheets were labelled 1-G through 1-N. Table I presents a summary of the measured physical test properties of the sample webs.

TABLE I

| Sample | % PET[1] | Basis Wt. (gsm) | Avg. Tensile[2] | Avg. Elongation[3] | Avg. TEA[4] | Normalized Toughness |
|---|---|---|---|---|---|---|
| 1-A | 0 | 60 | 3975 | 6.5 | 93 | 1.55 |
| 1-B | 30 | 60 | 3044 | 5.2 | 93 | 1.55 |
| 1-C | 40 | 60 | 2760 | 5.6 | 117 | 1.95 |
| 1-D | 50 | 60 | 2275 | 5.3 | 116 | 1.93 |
| 1-E | 60 | 60 | 2447 | 5.5 | 173 | 2.88 |
| 1-F | 75 | 60 | 1940 | 12.6 | 164 | 2.73 |
| 1-G | 30 | 59.9 | 2137 | 10 | 226 | 3.77 |
| 1-H | 40 | 62.7 | 2613 | 31 | 395 | 6.3 |
| 1-J | 50 | 61.5 | 2620 | 39 | 446 | 7.25 |
| 1-K | 60 | 61.6 | 3000 | 44 | 544 | 8.83 |
| 1-L | 70 | 61.2 | 2700 | 39 | 495 | 8.09 |
| 1-M | 80 | 61.7 | 3153 | 32 | 490 | 7.94 |

TABLE I-continued

| Sample | % PET[1] | Basis Wt. (gsm) | Avg. Tensile[2] | Avg. Elongation[3] | Avg. TEA[4] | Normalized Toughness |
|---|---|---|---|---|---|---|
| 1-N | 90 | 59.6 | 2710 | 24 | 340 | 5.7 |

[1]Percent polyethylene terephthalate fibers in the sheet
[2]Average dry strip tensile in g/25 mm in accordance with TAPPI Method T494 om 81 $\frac{(MD + CD)}{2}$
[3]Percent strain at ultimate tensile.
[4]AVG. TEA (cm-gm/cm$^2$) per TAPPI Method T494 om 81 $\frac{(MD + CD)}{2}$
[55]Normalized toughness $\frac{(MD + CD)}{2}$ divided by basis weight The data for the unentangled handsheets clearly show that tensile strength drops with increasing percentages of polyester in the furnish. The wood pulp in the furnish is thus the main contributor to the development of tensile strength in these sheets. On the other hand, sheet elongation remains essentially constant until high (about 75%) polyester fiber contents are reached. Toughness increases, reaching a maximum at 60% polyester content, and then gradually falls off. Apparently the long synthetic fiber is contributing significantly to the elongation and energy absorption under tensile loads. The rise and fall evident in the toughness is apparently the result of cumulative trends of falling tensile and rising elongation, since both contribute to toughness (TEA).

The data presented in Table I for the entangled handsheets shows an increase in strip tensile, elongation, and toughness and then a drop off as polyester fiber increases. The rapid increase in elongation with percent polyester is attributed to the increasing contribution of the entangled long polyester fiber, even at the very low energy level used here. The subsequent fall in tensile with further increasing polyester content is attributed to the decreasing contribution of the wood pulp to overall sheet properties.

FIG. 2 is a plot of the normalized toughness columns from Table I. The surprising increase in toughness is the result of applying the small amount of entanglement energy in accordance with the present invention. The levels of toughness obtained in the 50–70% polyester content range not only show the effectiveness of the current invention, but exceed the toughness typically obtained.

EXAMPLE 2

A wet-laid nonwoven web was formed from a furnish consisting of 60% 20 —1.5 denier polyethylene terephthalate staple fiber and 40% wood pulp consisting of a 50/50 blend of cedar pulp and eucalyptus fiber. The web was formed at 250 feet per minute on a single layer 84 mesh polyester filament Fourdrinier wire, and was passed under two water jet manifolds at a water pressure of 1000 psig. The web to nozzle gap was 0.75 inch, and the total applied entanglement energy was 0.052 hp-hr/lb. The web was then removed from the wire, dried and saturation treated (on a padder) to a 15% content of the crosslinkable acrylic latex binder of Example 1. The web was redried on steam cans and cured using a thru-air drier operating at about 450 degrees Farenheit. The web was post-treated with a micro-creping device called a "Micrex" of the type described in U.S. Pat. Nos. 3,260,778, 3,416,192, and 3,426,405.

The resultant web had a basis weight of 58 gsm. and a grab strength as measured by TAPPI T494 om-81 of 34.5 lbs. in the machine direction and 29.2 lbs. in the cross direction for a strength ratio of 1.18. It exhibited an elongation of 47 percent in the machine direction and 80 percent in the cross direction and a mullen burst strength of 61.7 psi. The handle-o-meter stiffness test of TAPPI T498 su-66 gave a value of 18 grams in the machine direction and 14 grams in the cross direction.

EXAMPLE 3

The procedure of Example 2 was used to produce four samples, each containing 70% of 1.5 denier polyester and 30% cedar wood pulp (Celfine). The length of the the polyester fiber was varied from 10 to 25 mm in 5 mm increments. The production speed on the inclined wire machine was 90 feet per minute. Each sample was entangled with two manifolds operating at 1000 psi and containing perforated strips with 92 micron diameter holes spaced 50 to the inch. An 84 mesh, 5 shed polyester forming fabric was used. Each sample was entangled at an energy input of 0.11 hp-hr/lb before removal from the forming wire. The samples were dried and saturation bonded to a 10% binder content with an acrylic latex binder. Table II lists the measured physical properties of the samples, and clearly illustrates the importance of fiber length in the development of strength in sheets made by the process of this invention.

TABLE II

| Fiber Length (mm) | 10 | 15 | 20 | 25 |
|---|---|---|---|---|
| L/D ratio | 800 | 1200 | 1600 | 2000 |
| Average Dry Tensile (g/25 mm)* | 1500 | 2200 | 3700 | 5000 |
| Average Dry Toughness (cm-g/cm$^2$)* | 150 | 370 | 700 | 800 |
| Average Grab Tensile (g)* | 6500 | 8500 | 12700 | 16700 |

*Average values are the mean of CD and MD.

EXAMPLE 4

This example shows that other types of natural cellulosic fibers besides wood pulp can be used to make useful products according to the process of this invention. Employing the same forming, entangling, and bonding conditions as used in Example 3, variety of samples was produced containing 70% of 20 mm 1.5 denier polyester fiber, and 30% natural fiber, as follows;

| | |
|---|---|
| Sheet 4-A | 20% hardwood, 10% cedar pulp (control) |
| Sheet 4-B | 30% Sisal |
| Sheet 4-C | 30% Abaca Hemp |

Table III presents the physical test properties of these sheets, and shows that the non-wood plant fibers yield products with higher tear strength and increased bulk when compared to wood pulp in this process.

EXAMPLE 5

In order to demonstrate the properties of webs containing polymeric fibers other than polyethylene terephthalate, Example 2 was repeated except that the polyester fibers were replaced with ¾"×1.5 dpf polypropylene fibers (Herculon Type 151 by Hercules) and with ½"×1.5 dpf rayon staple by North American. The webs were entangled using a total energy input of 0.11 hp-hr/lb. and exhibited a normalized average toughness of 6.2 for the polypropylene sheet and 4.4 for the rayon sheet.

TABLE III

| Sheet | 4-A | 4-B | 4-C |
|---|---|---|---|
| Basis Weight (g/m$^2$) | 70.7 | 72.9 | 70.4 |
| Thickness (microns) | 218 | 263 | 240 |
| Density (g/cc) | .324 | .277 | .293 |
| Air flow (1/min./100 cm$^2$) | 384 | 739 | 668 |
| Dry tensile (g/25 mm) | 2873 | 3462 | 2663 |
| Elongation (%) | 62.9 | 69.7 | 60.7 |
| Dry toughnes (cm-g/cm$^2$) | 455 | 634 | 452 |
| Grab tensile (g) | 10325 | 11875 | 10575 |
| Trapezoid tear* (g) | 3641 | 3985 | 3591 |
| Tongue tear** (g) | 1913 | 2562 | 2182 |
| Handle-O-Meter (g) | 21.7 | 19.1 | 18.7 |
| Dry tensile/ Handle-O-Meter | 132 | 181 | 142 |

*ASTM D1117-77
**ASTM D2261-83

EXAMPLE 6

Using the procedure of Example 2, machine made paper was produced on an inclined wire fourdrinier paper machine at basis weight levels of 30 and 60 gsm. Both paper weights were made from a fiber furnish of 60% 20 mm×1.5 dpf polyester and 40% wood pulp (Celfine) and subjected to entanglement by two manifolds of water jets. The 30 gsm paper was subject to manifold pressures of 400 and 700 psi for a total applied energy of. 0.098 hp-hr/lb. while the 60 gsm material was subject to pressures of 700 and 1000 psi for a total applied energy of 0.092 hp-hr/lb. Handsheets were cut from the machine made paper and the handsheets were saturation bonded in the laboratory to varying levels of binder pickup from 5 to 30%. The binder was an acrylic latex sold by B.F. Goodrich under the trademark "HYCAR 2600×334". The treated, dried and cured sheets were tested for their physical properties. FIG. 3 shows normalized average TEA as a function of binder pickup. This figure shows clearly that the lightly entangled webs of this invention exhibited strength values at 5–10% pickup that are comparable to the unentangled webs at 30% pickup. Thus it is possible to realize a 20–25% reduction in binder pickup, and the associated savings in cost. Improvements in softness also occurred along with a reduction in binder content.

As will be apparent to persons skilled in the art, various modifications, adaptations and variations of the foregoing specific disclosure can be made without departing from the teachings of the present invention.

We claim:

1. A method of producing a fiber entangled nonwoven web material comprising the steps of forming a dilute homogeneous fiber furnish of papermaking fibers and more than about 30 percent by weight of long synthetic fibers suited for being dispersed in an aqueous media; depositing the fibers from the furnish on a paper forming wire at the wet end of a paper-making machine to provide a fluidized homogeneously dispersed fibrous base web material having a liquid content of about 75% by weight or more; subjecting the fibrous base web having said liquid content to direct impingement of a series of entangling liquid jets to provide a total energy input of up to about 0.2 hp-hr/lb web to very lightly entangle the fibers in said base web; drying the entangled web and treating the web with a binder in an amount sufficient to provide a binder pickup of less than about 20% by weight based on the weight of the treated material.

2. The process of claim 1 wherein said fibrous base web is being carried by said paper-forming wire at the time it is entangled.

3. The process of claim 1 wherein the fiber furnish comprises about 10–60 percent natural fibers.

4. The process of claim 1 wherein the synthetic fiber content is about 50–80% by weight.

5. The process of claim 1 wherein the synthetic fibers have a fiber length in the range of about 15–30 mm.

6. The process of claim 1 wherein the total energy input falls in the range of 0.01 to 0.15 hp-hr/lb.

7. The process of claim 1 wherein the total energy input falls in the range of 0.05 to 0.12 hp-hr/lb.

8. The process of claim 1 wherein the series of entangling jets include plural manifolds of nozzles having an orifice size within the range of 0.05–0.2 mm.

9. The process of claim 8 wherein the nozzles in each manifold are spaced by a distance of about 0.2–10 mm.

10. The process of claim 1 wherein the entangling fluid jets are operated at a pressure of about 20–70 kilograms per square centimeter.

11. The process of claim 1 wherein the binder is applied as a latex dispersion in quantities sufficient to provide a pickup of about 3 to 15 percent by weight binder.

12. The process of claim 11 wherein the the binder is a cross-linkable acrylic material.

13. The process of claim 11 wherein the binder is applied uniformly to the base web.

14. The product obtained from the method of claim 1.

15. The product obtained from the method of claim 7.

16. The product obtained from the method of claim 11.

* * * * *